US008366235B2

(12) United States Patent
Hu et al.

(10) Patent No.: US 8,366,235 B2
(45) Date of Patent: Feb. 5, 2013

(54) PRINTING DEVICE WITH RECYCLING PAN

(75) Inventors: Hsing-Yi Hu, Taipei Hsien (TW); Chang-Lun Tai, Taipei Hsien (TW); Yi-Ming Liao, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 386 days.

(21) Appl. No.: 12/822,262

(22) Filed: Jun. 24, 2010

(65) Prior Publication Data

US 2011/0181653 A1 Jul. 28, 2011

(30) Foreign Application Priority Data

Jan. 25, 2010 (TW) ..... 99101870 A

(51) Int. Cl.
*B41J 2/165* (2006.01)

(52) U.S. Cl. ..... 347/29; 347/32; 347/36

(58) Field of Classification Search ..... None
See application file for complete search history.

(56) References Cited

U.S. PATENT DOCUMENTS

| | | | | | |
|---|---|---|---|---|---|
| 4,967,204 | A * | 10/1990 | Terasawa et al. | ..... | 347/23 |
| 5,483,267 | A * | 1/1996 | Nemura et al. | ..... | 347/32 |
| 5,617,125 | A * | 4/1997 | Chew | ..... | 347/36 |
| 6,322,196 | B1 * | 11/2001 | Lim | ..... | 347/35 |
| 6,695,429 | B2 * | 2/2004 | Barinaga | ..... | 347/28 |
| 7,029,093 | B2 * | 4/2006 | Tee et al. | ..... | 347/32 |
| 7,241,343 | B2 * | 7/2007 | Kojima | ..... | 118/302 |
| 7,963,631 | B2 * | 6/2011 | Albertalli et al. | ..... | 347/29 |
| 8,118,399 | B2 * | 2/2012 | Kanbara et al. | ..... | 347/35 |
| 2007/0222813 | A1 * | 9/2007 | Lee | ..... | 347/29 |
| 2008/0278537 | A1 * | 11/2008 | Watanabe | ..... | 347/32 |
| 2009/0195593 | A1 * | 8/2009 | Iwanaga | ..... | 347/32 |

* cited by examiner

*Primary Examiner* — Stephen Meier
*Assistant Examiner* — Leonard S Liang
(74) *Attorney, Agent, or Firm* — Altis Law Group, Inc.

(57) ABSTRACT

A printing device for printing work pieces includes a main body, an ink jet mounted on the main body, a recycling pan below the ink jet, a driving assembly positioned on the main body for driving the recycling pan, a controller for controlling the driving assembly and a sensor for detecting a work piece and sending a result to the controller. The controller directs the driving assembly to move the recycling pan below the ink jet to receive ink from the ink jet when the work piece is no longer present.

13 Claims, 5 Drawing Sheets

PRINTING DEVICE WITH RECYCLING PAN

BACKGROUND

1. Technical Field

The present disclosure relates to a printing device and, particularly, to a printing device with a recycling pan.

2. Description of the Related Art

When a continuous inkjet printing device prints work pieces in order, the ink jet may spray ink outside of the area of work pieces at an interval between two adjacent work pieces, the sprayed ink also contaminates a supporting member supporting the work pieces, and also resulting in a waste of ink.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views, and both the views are schematic.

DETAILED DESCRIPTION

Figure 1:
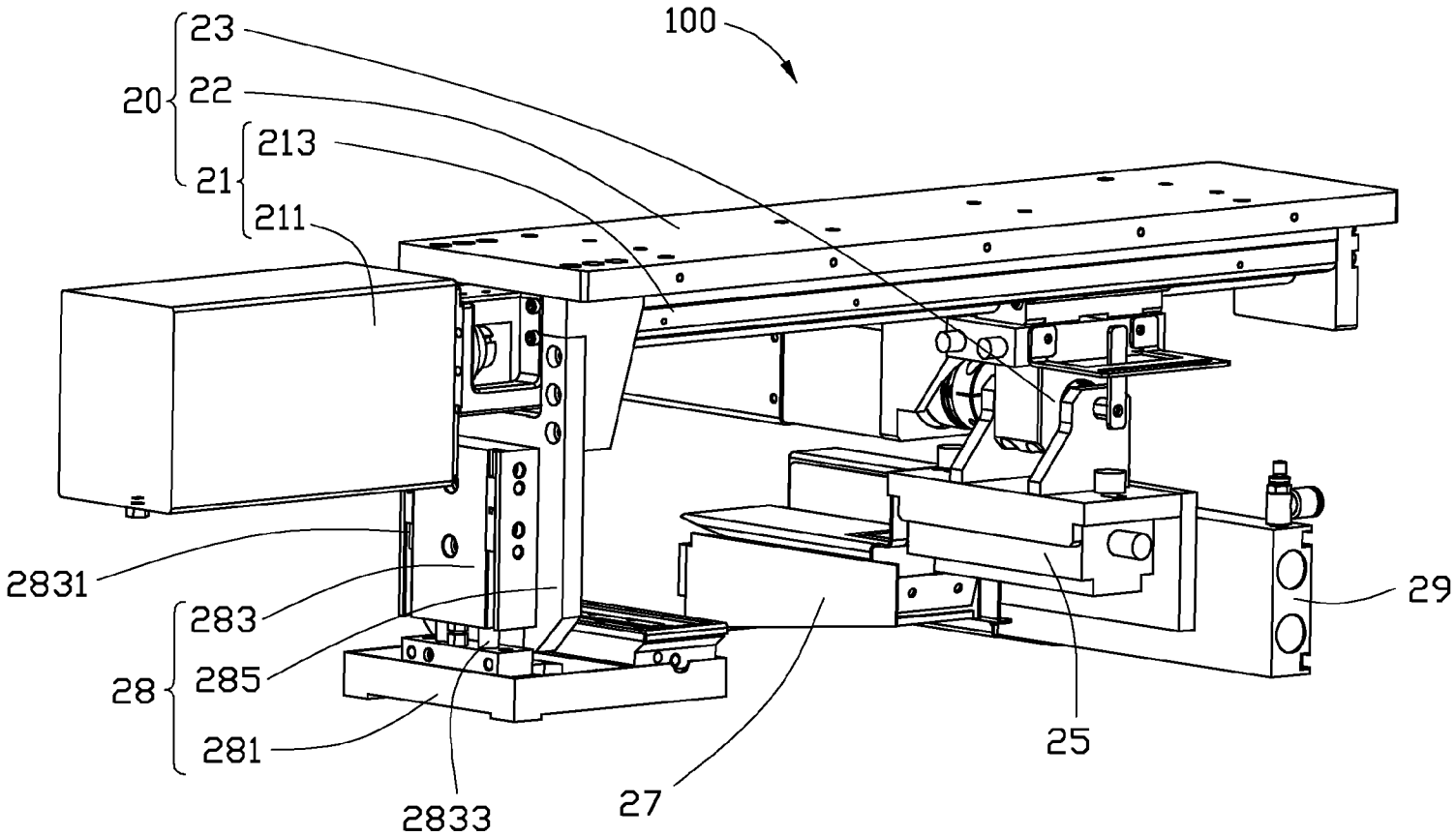
FIG. 1 is an isometric view of an embodiment of a printing device.

Referring to FIG. 1, an embodiment of a printing device includes a main body 20, an ink jet 25 mounted on the main body 20, a recycling pan 27 positioned below the ink jet 25, a cleaning module 28 mounted on the main body 20 and a driving assembly 29 for driving the recycling pan 27. The main body 20 includes a sliding assembly 21, a cover 22 and a rotary assembly 23 fixed on the sliding assembly 21.

Figure 2:
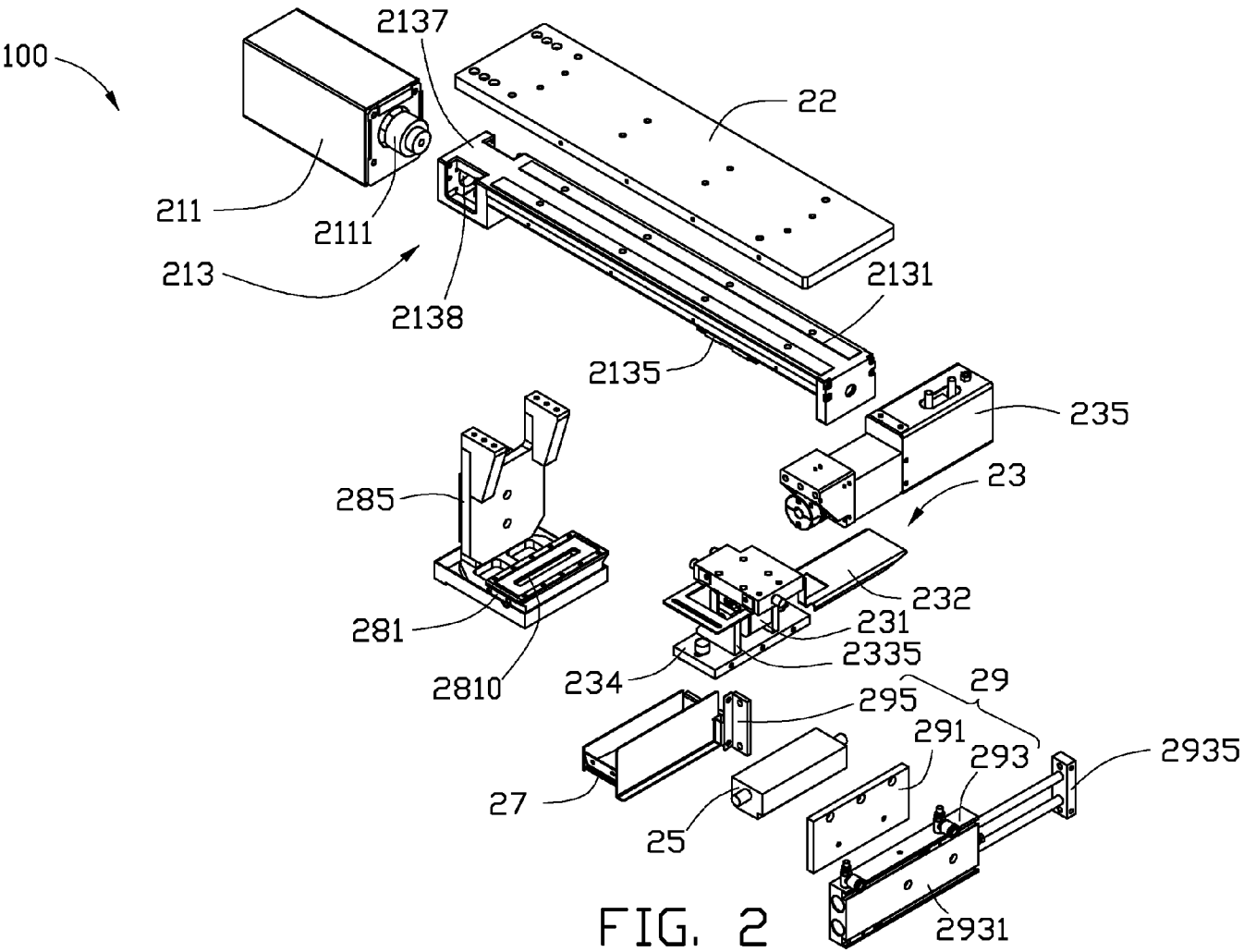
FIG. 2 is an exploded, isometric view of the printing device shown in FIG. 1, the printing device including a rotary assembly.
Figure 3:
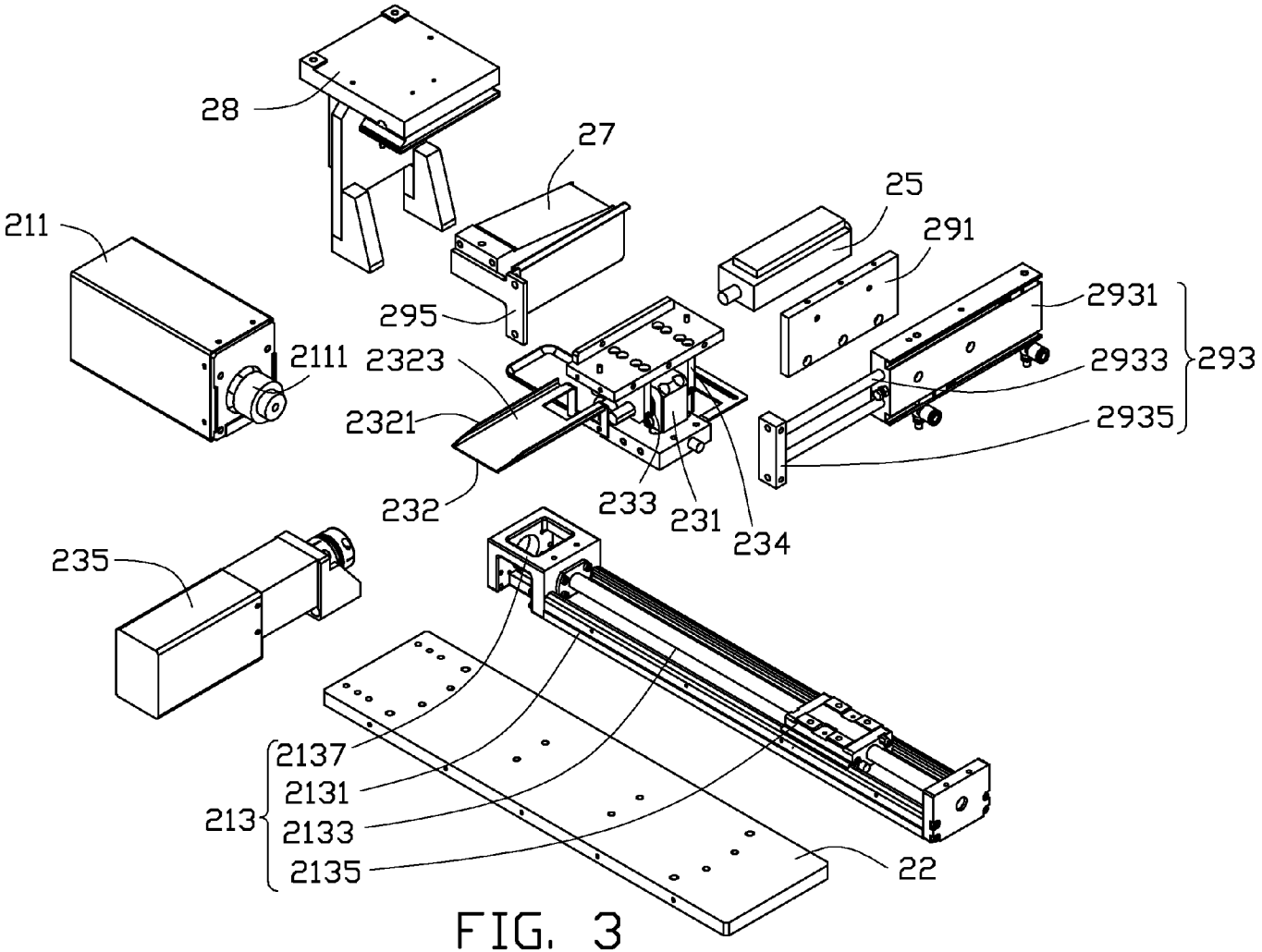
FIG. 3 is similar to FIG. 2, but viewed from another aspect.

Also referring to FIGS. 2 and 3, the sliding member 21 includes a motor 211 and a linear driving mechanism 213. The motor 211 has a rotary output shaft 2111. In the illustrated embodiment, the linear driving mechanism 213 is a ball screw mechanism, and includes a rail 2131, a ball screw 2133, a slipper 2135 sleeved on the ball screw 2133 and a frame 2137. The frame 2137 is mounted at an end of the rail 2131; the motor 211 is mounted on the frame 2137, and the output shaft 2111 of the motor 211 is connected to the ball screw 2133 for driving the slipper 2135 along the rail 2131. In an alternative embodiment, the linear driving mechanism 213 may be a worm and wheel gear mechanism. The cover 22 is fixed on an outer surface of the rail 2131 away from the ball screw 2133, to protect the linear driving mechanism 213.

Figure 4:
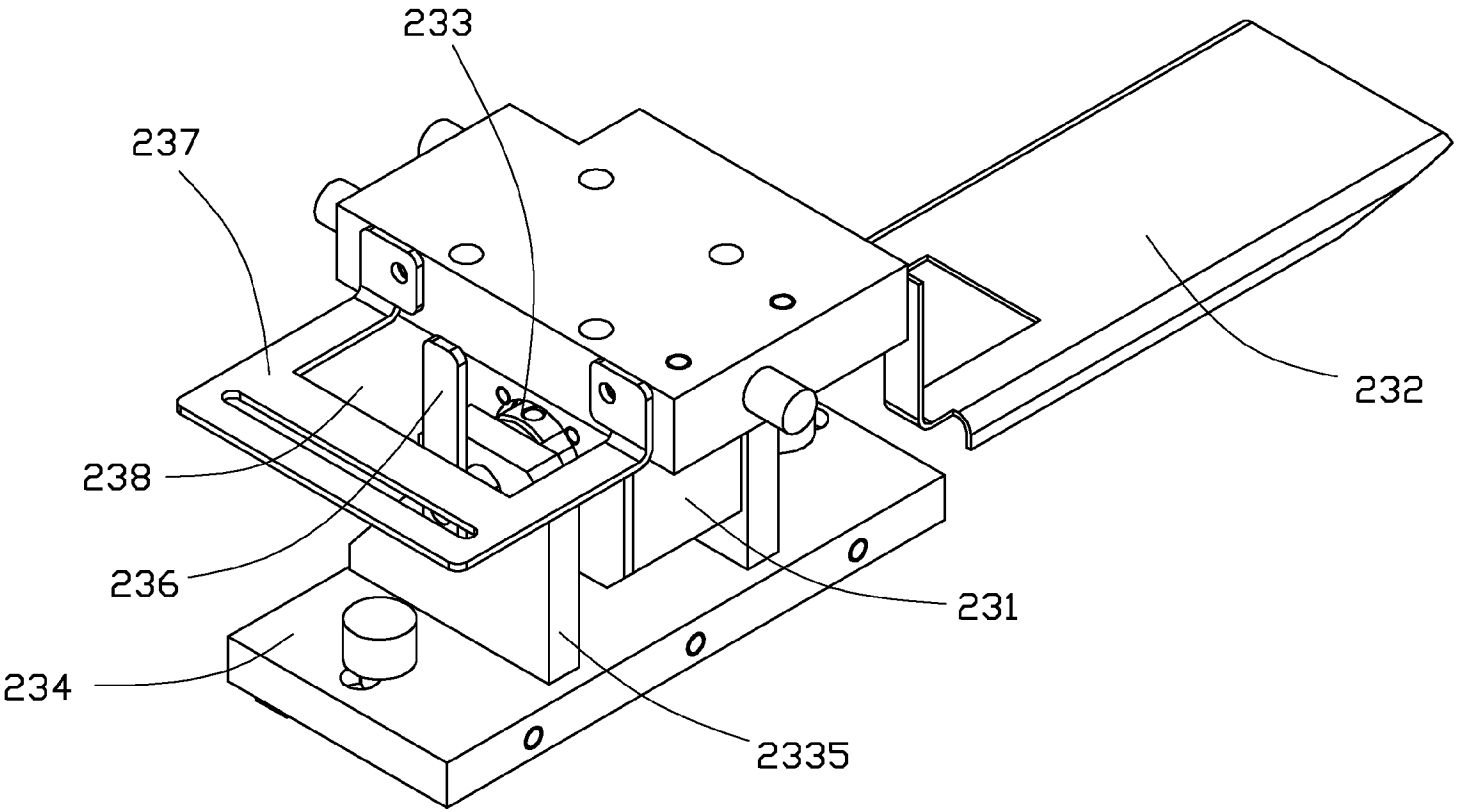
FIG. 4 is an isometric view of the rotary assembly shown in FIG. 2

Referring also to FIG. 4, the rotary assembly 23 includes a fixing block 231, a covering plate 232 for covering the recycling pan 27, a shaft 233, a mounting board 234 and a rotating motor 235. The shaft 233 is received in the fixing block 231, and both ends of the shaft 233 are exposed out of the fixing block 231. The rotating motor 235 is also mounted on the fixing block 231 and connected to an end of the rotating motor 235, to drive the shaft 233 to rotate in the fixing block 231. The rotary assembly 23 further includes two fixing boards 2335 fixed on two exposed ends on the shaft respectively, a limiting rod 236 and a limiting sheet 237 fixed on the fixing block 231 adjacent to the rotating motor 235 (FIG. 2). The limiting sheet 237 defines a limiting hole 238. The limiting rod 236 is fixed at the exposed end of the shaft 233 adjacent to the rotating motor 235, and received in the limiting hole 238. When the shaft 233 is rotated, the limiting rod 236 may be blocked by edges of the limiting hole 238, thus limiting a rotary angle of the shaft 233. The covering plate 232 is substantially rectangular, and forms a stopping portion 2321 at each side. The covering plate 232 defines a channel 2323 between the stopping portions 2321. The fixing block 231 is mounted on the slipper 2135, such that the rotary assembly 23 can slide along the rail 2131 following the slipper 2135.

The cleaning module 28 includes a cleaning base 281, an adjusting cylinder 283 and a connecting plate 285 (shown in FIG. 1). The adjusting cylinder 283 includes a body 2831 and a pair of rods 2833 slidably positioned in the cylinder block 2831, and an end of the rod 2833 protruding out of the cylinder block 2831. The cylinder block 2831 is fixed on the connecting board 285. The end of each rod 2833 is connected to the cleaning base 281. The cleaning base 281 defines a cleaning slot 2810. The connecting board 285 is fixed on the frame 2137 of the sliding assembly 21, thus the adjusting cylinder 283 is capable of adjusting the height of the cleaning seat 281 relative to the cover 22, for cleaning the ink jet 25 when the ink jet 25 is reset.

The driving assembly 29 includes a positioning board 291, a cylinder 293 and a connecting member 295. The cylinder 293 includes a cylinder block 2931, two push rods 2933 and a pushing block 2935. An end of each pushing rod 2933 is slidably positioned in the cylinder block 2931, the other end is connected to the pushing block 2935. The pushing rod 2933 is capable of protruding out of the cylinder block 2931 or drawing back the cylinder block 2931. The positioning board 291 is fixed at a side of the mounting board 234, and substantially perpendicular to the mounting board 234. The cylinder 293 is fixed at a surface of the positioning board 291 away from the mounting board 234. The recycling pan 27 is fixed on the other surface of the positioning board 291 adjacent to the mounting board 234, and below the ink jet 25, for receiving the ink from the ink jet 25. The connecting member 295 interconnects the pushing block 2935 and the recycling pan 27, thus the cylinder 291 is capable of moving the recycling pan 27 in the channel 2323, to cover or uncover the ink jet 25. When the ink jet 25 is open, the covering plate 232 covers the recycling pan 27, to prevent the ink in the recycling pan 27 from contaminants.

Figure 5:
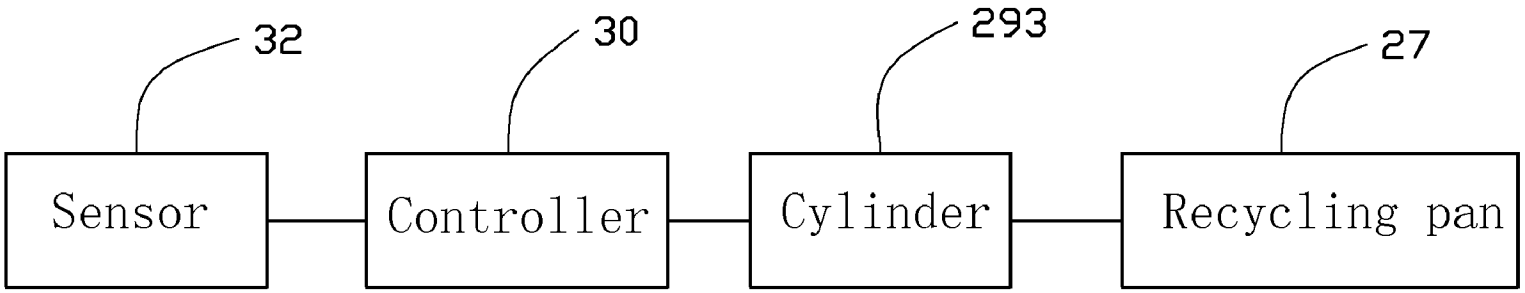
FIG. 5 is a principle view of the printing device shown in FIG. 1.

Also referring to the FIG. 5, the printing device 100 further includes a controller 30 for controlling the driving assembly 29 and a sensor 32 for checking whether the work pieces (not shown) are on the conveyor belt (not shown), and sending the result to the controller 30. The controller 30 directs the driving assembly 29 to draw back the recycling pan 27 when there is no work piece on the conveyor belt.

The ink jet 25 is covered by the recycling pan 27. When a work piece is detected by the sensor 32 in the printing area of the ink jet 25, the controller 30 directs the pushing rod 2933 of the cylinder 293 to draw back, thus the ink jet 27 can print the work piece. The driving assembly 29 is capable of rotating the ink jet 25, and the linear driving mechanism 213 is capable of moving the ink jet 25 along the rail 2131 simultaneously, to secure all the work pieces for printing. When no work piece is detected by the sensor 32 in the printing area of the ink jet 25, the controller 30 directs the pushing rod 2933 to push out, thus the recycling pan 27 covers the ink jet 25, and receives the ink sprayed from the ink jet 25 for reuse. After all the work pieces are printed, the linear driving mechanism 213 moves the ink jet 25 to an end of the rail 2131, and the cleaning module 28 cleans the ink jet 25.

The printing device 100 includes a moveable recycling pan 27 below the ink jet 25, a driving assembly 29 for driving the recycling pan 27, a sensor 32 for detecting the work piece and a controller 30 controlling the driving assembly 29 according to the result from the sensor 32, thus the recycling pan 27 can cover the ink jet 25 automatically, and ink is conserved.

Finally, while particular embodiments have been described, the description is illustrative and is not to be construed as limiting. For example, various modifications can be made to the embodiments by those of ordinary skill in the art without departing from the true spirit and scope of the invention as defined by the appended claims.

What is claimed is:

1. A printing device for printing work pieces comprising:
a main body;
an ink jet mounted on the main body;
a recycling pan below the ink jet;
a driving assembly comprising a positioning board fixed on the main body, a cylinder and a connecting member; the recycling pan and the cylinder at two sides of the positioning board and the connecting member interconnecting the cylinder and the recycling pan, the cylinder capable of driving the recycling pan;
a controller for controlling the driving assembly;
a sensor for detecting a work piece and sending a result to the controller;
wherein the controller directs the driving assembly to move the recycling pan below the ink jet to receive ink from the ink jet when the work piece is no longer detected.

2. The printing device of claim 1, wherein the cylinder comprises a cylinder block, a pushing rod and a pushing block, an end of the pushing rod is slidably positioned in the cylinder block, the other end of the pushing rod is connected to the pushing block, the connecting member is fixed on the pushing block.

3. The printing device of claim 2, wherein the main body comprising a rotary mechanism, the rotary mechanism comprising a fixing block, a shaft rotatably positioned in the fixing block, a rotary motor and a mounting board interconnecting the shaft and the cylinder, the rotary motor is mounted on the fixing block for driving the shaft.

4. The printing device of claim 3, wherein the rotary assembly further comprising a covering plate for covering the recycling pan.

5. The printing device of claim 3, wherein the main body further comprises a limiting sheet fixed on the fixing block, the limiting sheet defining a limiting hole and the main body further comprising a limiting rod received in the limiting hole for limiting a rotary angle of the shaft when rotating.

6. The printing device of claim 3, wherein the printing device further comprises a sliding mechanism, the sliding mechanism comprises a linear driving mechanism and a motor for driving the linear driving mechanism, and the linear driving mechanism comprises a rail and a slipper slidably positioned on the rail, the slipper connected to the fixing block.

7. The printing device of claim 6, wherein the linear driving mechanism is a screw mechanism; the linear driving mechanism further comprises a ball screw passing through the slipper.

8. A printing device for printing work pieces comprising:
a main body;
an ink jet mounted on the main body;
a covering plate mounted on the main body adjacent to the ink jet;
a recycling pan below the covering plate, and covered by the covering plate;
a driving assembly comprising a positioning board fixed on the main body, a cylinder and a connecting member; the recycling pan and the cylinder at two sides of the positioning board and the connecting member interconnecting the cylinder and the recycling pan, the cylinder capable of driving the recycling pan;
a controller for controlling the driving assembly;
a sensor for detecting a work pieces and sending a result to the controller;
wherein the controller directs the driving assembly to move the recycling pan to a position below the ink jet to receive ink from the ink jet when the work piece is no longer detected.

9. The printing device of claim 8, wherein the cylinder comprises a cylinder block, a pushing rod and a pushing block, an end of the pushing rod slidably positioned in the cylinder block, the other end of the pushing rod connected to the pushing block, and the connecting member is fixed on the pushing block.

10. The printing device of claim 9, wherein the main body comprises a rotary mechanism, the rotary mechanism comprising a fixing block, a shaft rotatably positioned in the fixing block, a rotary motor and a mounting board interconnecting the shaft and the cylinder, the rotary motor is mounted on the fixing block for driving the shaft.

11. The printing device of claim 10, wherein the main body further comprises a limiting sheet fixed on the fixing block, the limiting sheet defines a limiting hole, the main body further comprising a limiting rod received in the limiting hole for limiting a rotary angle of the shaft when rotating.

12. The printing device of claim 10, wherein the printing device further comprises a sliding mechanism comprising a linear driving mechanism and a motor for driving the linear driving mechanism, the linear driving mechanism comprising a rail and a slipper slidably positioned on the rail, the slipper is connected to the fixing block.

13. The printing device of claim 12, wherein the linear driving mechanism is a screw mechanism, the linear driving mechanism further comprising a ball screw passing through the slipper.

* * * * *